US008007232B2

(12) United States Patent
Hwang et al.

(10) Patent No.: US 8,007,232 B2
(45) Date of Patent: Aug. 30, 2011

(54) CENTRIFUGAL FAN AND IMPELLER THEREOF

(75) Inventors: Ching-Bai Hwang, Taipei Hsien (TW); Zhi-Hui Zhao, Shenzhen (CN); Jie Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 927 days.

(21) Appl. No.: 11/957,327

(22) Filed: Dec. 14, 2007

(65) Prior Publication Data

US 2009/0053052 A1 Feb. 26, 2009

(30) Foreign Application Priority Data

Aug. 24, 2007 (CN) ..... 2007 1 0076559

(51) Int. Cl.
*F04D 29/42* (2006.01)

(52) U.S. Cl. ..... 415/206; 415/182.1; 415/208.1

(58) Field of Classification Search ..... 415/206, 415/182.1, 208.1, 175, 203, 213.1, 214.1; 416/195, 194, 196 R, 182, 185
See application file for complete search history.

(56) References Cited

U.S. PATENT DOCUMENTS 7,318,703 B2 * 1/2008 Schober et al. ..... 416/185

FOREIGN PATENT DOCUMENTS

| | | |
|---|---|---|
| CN | 1241248 A | 1/2000 |
| CN | 2508028 Y | 8/2002 |
| CN | 2697361 Y | 5/2005 |

* cited by examiner

*Primary Examiner* — Edward Look
*Assistant Examiner* — Dwayne J White
(74) *Attorney, Agent, or Firm* — Altis Law Group, Inc.

(57) ABSTRACT

A centrifugal fan includes a fan frame (20) and an impeller (40) received in the fan frame. The impeller includes a hub (41) having a circular top wall (410) and a cylindrical side wall (412) extending downwardly from a rim of the circular top wall, a plurality of blades (42) extending radially from the side wall of the hub and a blade ring (44). The blade ring includes an annular top plate (441), a cylindrical sidewall (442) extending downwardly from an outer periphery of the top plate, and a flange (443) extending outwardly from a bottom of the cylindrical sidewall. The blade ring is arranged on top surfaces of the blades received in an air inlet (24*a*) defined in a top surface of the fan frame, and the top plate of the blade ring and the top surface of the fan frame are coplanar with each other.

12 Claims, 6 Drawing Sheets

CENTRIFUGAL FAN AND IMPELLER THEREOF

BACKGROUND

1. Field of the Invention

The present invention relates generally to an impeller, and more particularly to a centrifugal fan incorporating the impeller for dissipating heat generated by electronic components.

2. Description of Related Art

With the fast development of the electronics industry, electronic components such as CPUs (central processing units), or VGA (video graphics array) are being made with ever faster operating speeds. During operation of the electronic components, a large amount of heat is generated. Greater emphasis is now being laid on increasing the efficiency and effectiveness of heat dissipation devices so as to keep operational temperature of the electronic components within a suitable range.

Conventionally, a fan is used in combination with a heat dissipation device to produce an airflow in order to remove heat from the electronic components. Since most of electronic systems that contain electronic components therein such as a laptop computer, or a notebook computer do not have enough space therein, a centrifugal fan which requires only a small space for installation is generally used, wherein the centrifugal fan includes a housing, a hub and a plurality of blades extending radially from the hub. A first air inlet and a second air inlet are defined in central portions of top and bottom surfaces of the housing respectively, and an air outlet is defined in a side wall of the housing and is oriented perpendicularly to the air inlets. In use, the blades of the centrifugal fan rotate to engender the airflow towards the electronic component, thus cooling the electronic component continuously.

The diameters of the first and second air inlets are equal to each other and are both smaller than the diameter of the fan blades. For avoiding friction between the fan blades and the housing, a clearance must be defined between each of the top and bottom surfaces of the housing and the fan blades, which conflicts with the requirement for the fan blades to fully make use of the limited space in the electronic system in which the centrifugal fan is mounted. Additionally, for increasing the heat dissipation effectiveness of the centrifugal fan, a general way is either to increase a revolving speed of the fan blades or to change the shape of the fan blades in order to relatively increase the amount of the airflow. However, increasing the revolving speed may cause a noise of the fan to rise correspondingly, while changing the shape of the fan blades requires redesign of the fan blades and is difficult to achieve.

What is needed, therefore, is an impeller and a centrifugal fan with the impeller which can overcome the above-mentioned disadvantage.

SUMMARY OF THE INVENTION

The present invention relates, in one aspect, to a fan impeller. According to a preferred embodiment of the present invention, the fan impeller includes a hub, a plurality of fan blades and a blade ring arranges on a top of the fan blades. The hub includes a circular top wall and a cylindrical side wall extending downwardly from a rim of the circular top wall. The fan blades extend radially and outwardly from a periphery of the side wall of the hub. The blade ring includes an annular top plate, a cylindrical sidewall extending downwardly from an outer periphery of the top plate, and a flange extending outwardly from a bottom of the cylindrical sidewall.

The present invention relates, in another aspect, to a centrifugal fan. According to a preferred embodiment of the present invention, the centrifugal fan includes a fan frame and an impeller received in the fan frame. The fan frame includes a bottom base and an opposite top cover. The impeller includes a hub, a plurality of blades extending radially and outwardly from a periphery of the hub, and a blade ring including an annular top plate being arranged on top surfaces of the blades. The top plate of the blade ring and the top cover of the fan frame are received in an air inlet defined in the top cover and are coplanar with the top cover.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
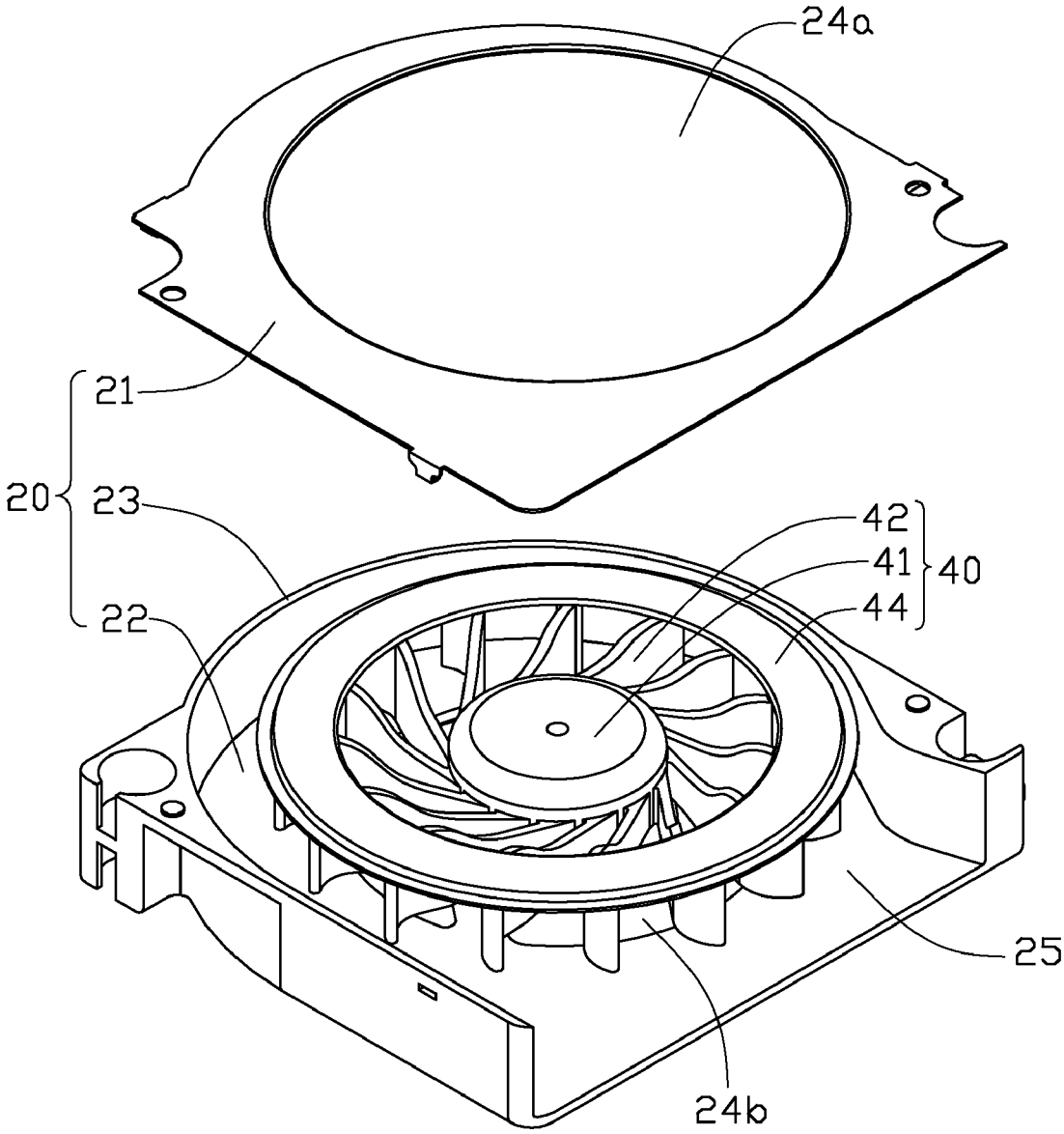
FIG. 1 is an exploded, isometric view of a centrifugal fan in accordance with a preferred embodiment of the present invention.
Figure 2:
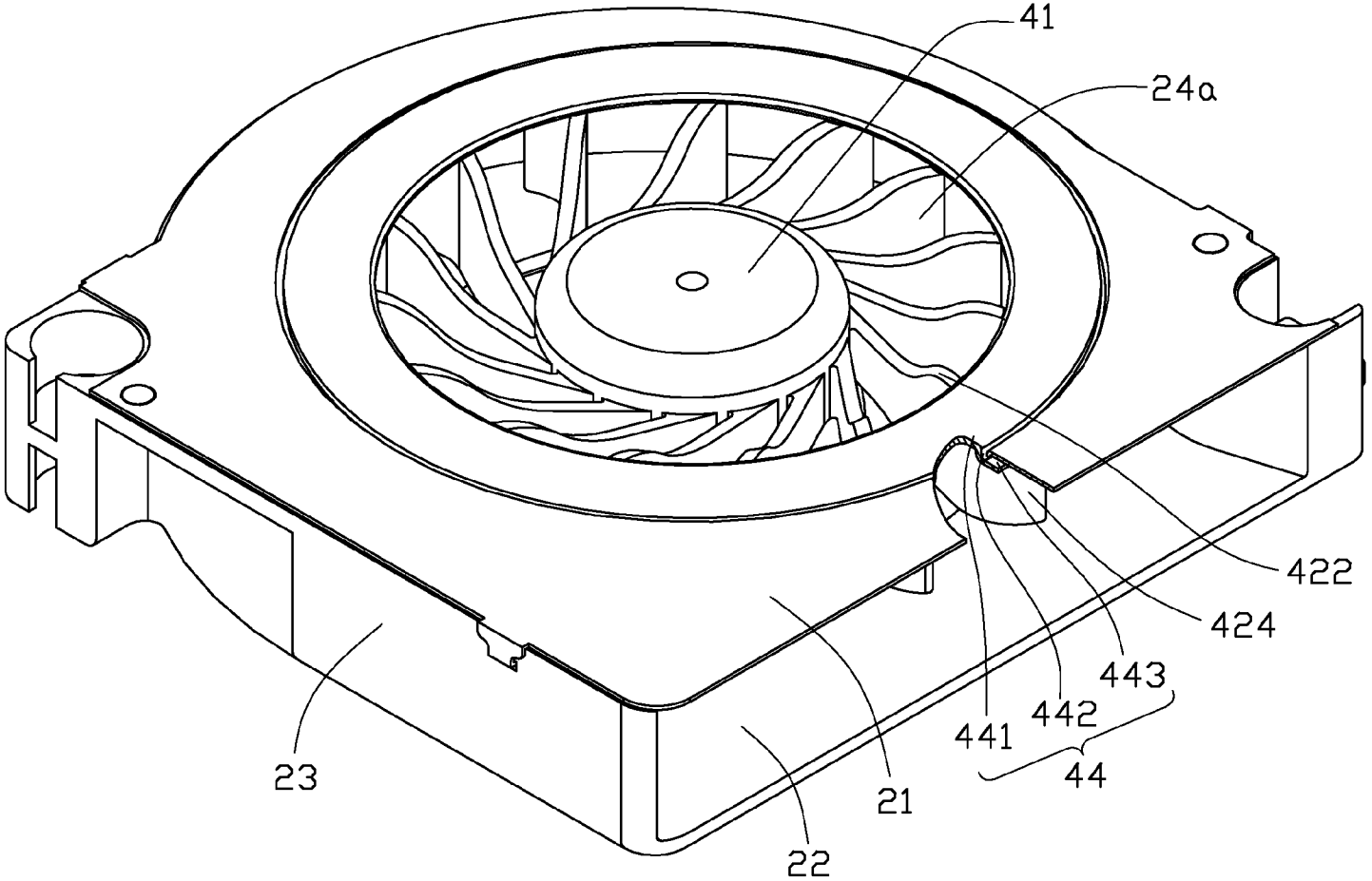
FIG. 2 is an assembled, isometric view of the centrifugal fan of FIG. 1, with one portion thereof being exscinded for clearly showing an inner structure of the centrifugal fan.

Referring to FIG. 1 and FIG. 2, a centrifugal fan according to a preferred embodiment of the present invention is shown. The centrifugal fan includes a fan frame 20 and a fan impeller 40 contained in the fan frame 20.

The fan frame 20 includes a top cover 21 arranged at a top side of the impeller 40, a bottom base 22 paralleled to the top cover 21 and arranged at a bottom side of the impeller 40, and an annular wall 23 interconnecting the top cover 21 and the bottom base 22 and surrounding the impeller 40. The top cover 21, the bottom base 22 and the annular wall 23 cooperatively define an inner space (not labeled) for receiving the impeller 40 therein. A first air inlet 24*a* is defined in a central portion of the top cover 21 and a second air inlet 24*b* is defined in a central portion of the bottom base 22, a diameter of the first air inlet 24*a* being lager than that of the second air inlet 24*b*. An air outlet 25 is defined in one side of the annular wall 23 of the fan frame 20 and is oriented perpendicularly to the air inlets 24*a*, 24*b*.

Figure 3:
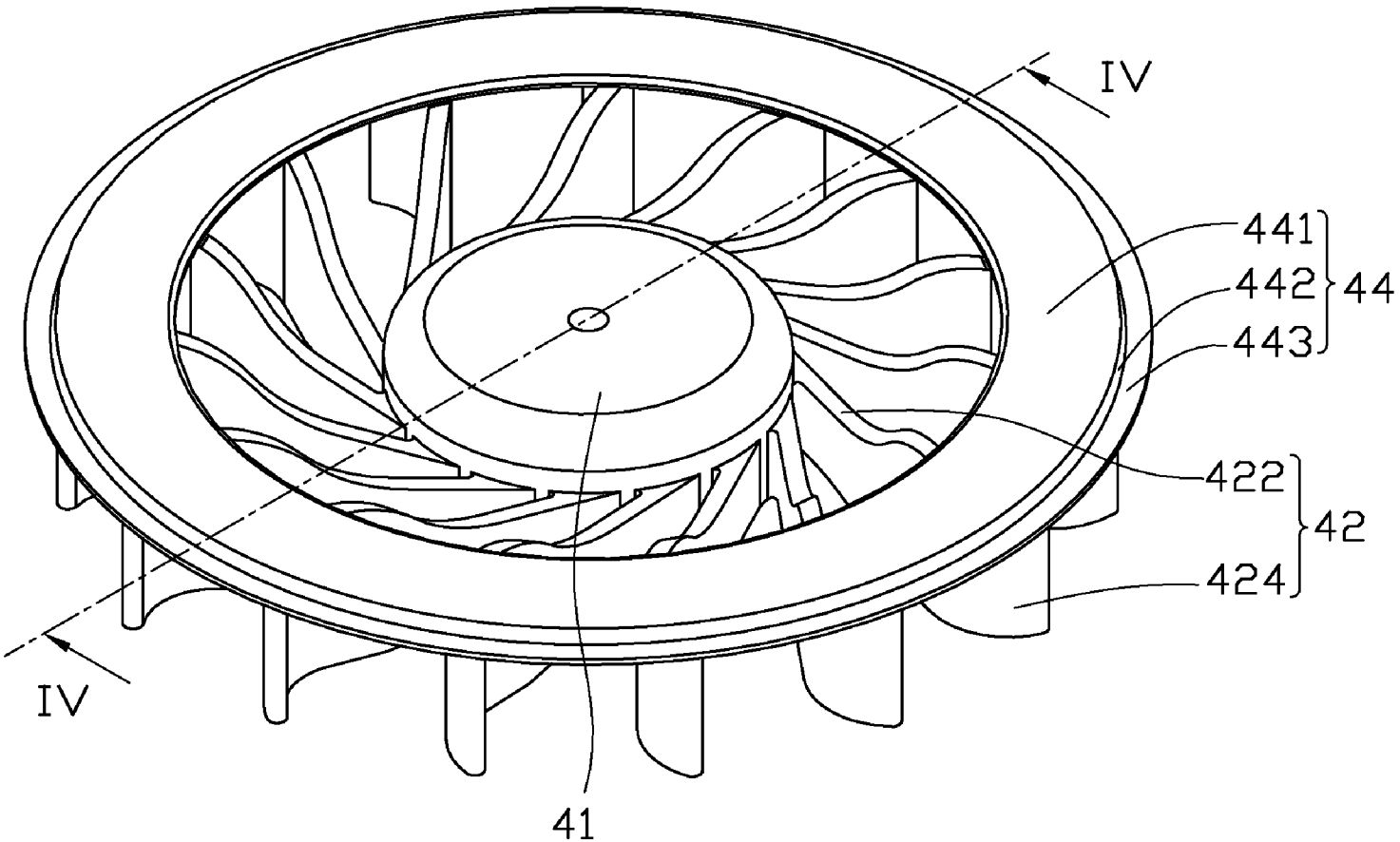
FIG. 3 is an isometric view of an impeller of the centrifugal fan of FIG. 1.
Figure 4:
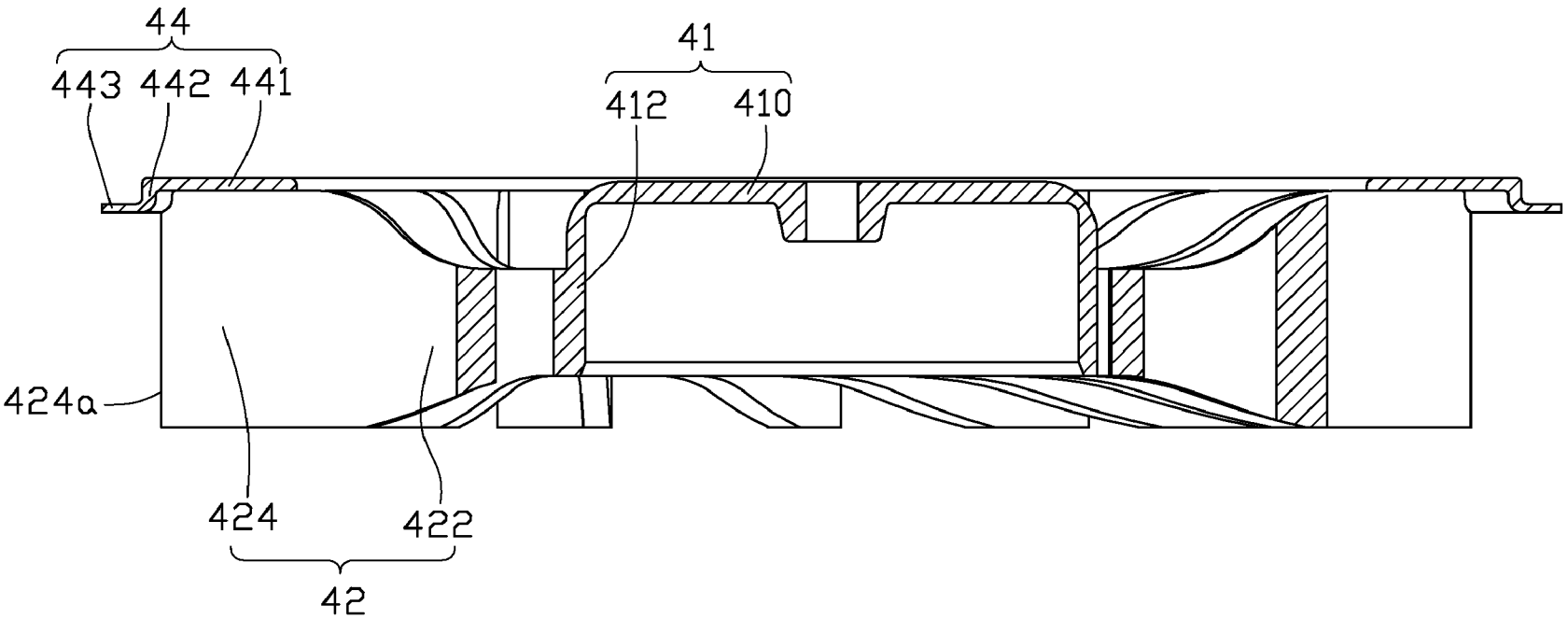
FIG. 4 is a cross-sectional view of the impeller of FIG. 3.

The impeller 40 is driven by a stator (not shown) of the centrifugal fan to be rotatable with respect to the stator in the frame 20. Referring to FIG. 3 and FIG. 4, the impeller 40 includes a hub 41, a plurality of blades 42 extending radially and outwardly from an outer periphery of the hub 41 and a blade ring 44 fixedly mounted on a top surface of the blades 42 at a position near outmost free ends of the blades 42. The hub 41 includes a circular top wall 410 and a cylindrical side wall 412 extending downwardly and perpendicularly from a rim of the top wall 410. A cylindrical space (not shown) is defined in the hub 41 by the top wall 410 and the side wall 412 cooperatively for accommodating the stator therein.

Figure 5:
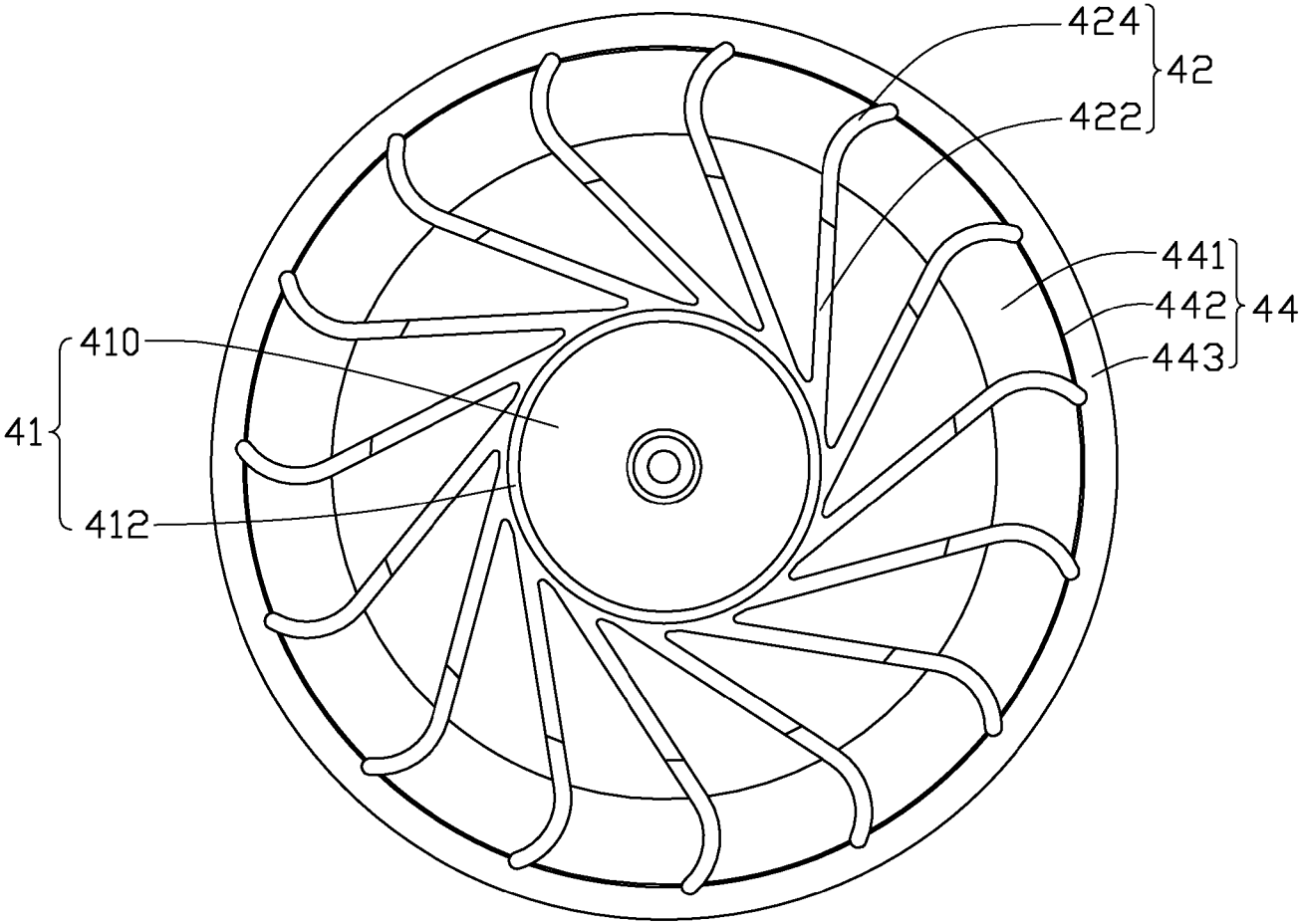
FIG. 5 is a bottom plan view of the impeller of FIG. 3.

Referring to FIG. 5, the blades 42 extend radially and outwardly from the side wall 412 of the hub 41. Each of the blades 42 includes a first portion 422 fixed to the side wall 412 of the hub 41 and a second portion 424 bent slantwise and smoothly from a distal end of the first portion 422. The first portion 422 of each of the blades 42 is planar-shaped and extends inclinedly with respect to the side wall 412 of the hub 41, and the second portion 424 of each of the blades 42 is curved as arc-shaped with respect to the corresponding first portion 422. Each of the first portions 422 has a top face and an opposite bottom face. The top face of the first portion 422 protrudes upwardly as the first portion 422 extends outwardly from the side wall 412 of the hub 41, while the bottom face of the first portion 422 protrudes downwardly as the first portion 422 extends outwardly from the side wall 412 of the hub 41, thus a longitudinal height of the first portion 422 gradually increases as the first portion 422 extends outwardly from the hub 41 towards the second portion 424. Each second portion 424 also has a top face and an opposite bottom face. The top face and the bottom face of the second portion 424 are parallel to the top wall 410 of the hub 41, a longitudinal height of the second portion 424 being constant as the second portion 424 extends outwardly from the corresponding first portion 422.

The blade ring 44 and the blades 42 are integrally formed by injection molding process as a single piece. The blade ring 44 includes an annular top plate 441, a cylindrical sidewall 442 extending perpendicularly and downwardly from an outer periphery of the top plate 441, and an annular flange 443 extending outwardly and radially from a bottom of the sidewall 442. An inner diameter of the top plate 441 is approximately the same as the diameter of the second air inlet 24*b*, and an outer diameter of the top plate 441 is a little smaller than that of the first air inlet 24*a*. In this embodiment, the inner diameter of the top plate 441 is the same as that of the second air inlet 24*b*. The top plate 441 of the blade ring 44 covers on and overlaps with the top faces of the second portions 424 of the blades 42, an outer periphery of the top plate 441 being aligned with an outmost longitudinal edge 424*a* of each of the blades 42. From the bottom plan view of the impeller 40 as shown in FIG. 5, the first portion 422 of each of the blades 42 is linear in profile, and the second portion 424 of each of the blades 42 is arc-shaped in profile and located just under the top plate 441 of the blade ring 44.

Referring back to FIG. 2, in assembly, the blade ring 44 is received in the first air inlet 24*a* of the top cover 21 of the centrifugal fan. A top surface of the top plate 441 of the blade ring 44 is coplanar with a top surface of the top cover 21 of the centrifugal fan; thus, a height of the second portion 424 of each of the blades 42 under the top plate 441 is increased. The sidewall 442 of the blade ring 44 surrounds a top edge portion of the outmost longitudinal edge 424*a* of each of the blades 42. A radial clearance of about 0.5 mm is formed between the sidewall 442 and the top cover 21 to avoid contact and friction between the sidewall 442 and the top cover 21 as the impeller 40 rotates relative to the cover 21 of the centrifugal fan. The flange 443 of the blade ring 44 is located directly under and overlaps with the top cover 21 of the fan frame 20. The flange 443 is parallel to and is vertically spaced a distance of about 0.5 mm from the top cover 21 to avoid contact and friction between the flange 443 and the top cover 21 during operation of the centrifugal fan.

Generally, a longitudinal height of a fan blade of a centrifugal fan for use in a portable computer varies in a range of 6 mm to 8 mm. A thickness of a top cover of a fan frame of the centrifugal fan is about 0.3 mm. In conventional art, the top cover extends over the fan blade of the centrifugal fan and a vertical clearance of at least 1 mm must be formed between the fan blade and the top cover for avoiding contact and friction during operation of the centrifugal fan. In the centrifugal fan of the above embodiment, however, the blade ring 44 rotates together with the blades 42 as the impeller 40 rotates. The second portions 424 of the blades 42 are located under the blade ring 44 and the blades 42 do not extend under the top cover 21. Accordingly, no vertical clearance is required between the blades 42 and the top cover 21. Therefore, the second portions 424 of the blades 42 can extend upwardly up to the top plate 441 of the blade ring 44, i.e., a position where the top cover 21 of the fan frame 20 resides. Since the blade ring 44 and the top cover 21 are coplanar with each other, a longitudinal height of the second portion 424 of each of the blades 42 is increased about 1.0 mm, compared with conventional centrifugal fans. In another aspect, the inner diameter of the blade ring 44 is substantially the same as that of the second air inlet 24*b*, which makes external air flow into the centrifugal fan more smoothly via the first and second air inlets 24*a*, 24*b* during operation of the centrifugal fan. In a performance test of the centrifugal fan with the impeller 40, air pressure and amount of airflow are increased by 8%~13% due to the height increase of the blades 42.

Figure 6:
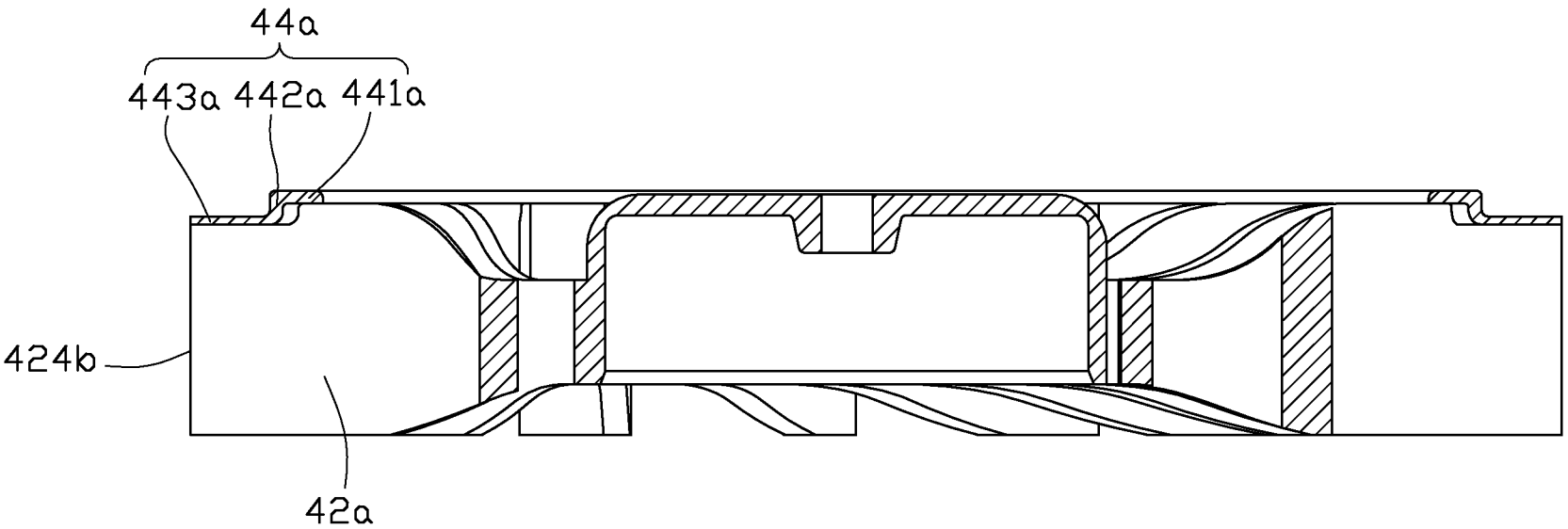
FIG. 6 is a cross-sectional view of an impeller according to a second embodiment of the present invention.

FIG. 6 shows a second embodiment of the impeller. Except for the shape of the blades 42*a* and the blade ring 44*a*, other parts of the impeller in accordance with this second embodiment have substantially the same configurations as the impeller 40 of the previous first embodiment. More specifically, the blade ring 44*a* includes a top plate 441*a*, a sidewall 442*a* extending downwardly from the top plate 441*a* and a flange 443*a* extending outwardly from the sidewall 442*a*. The flange 443*a* is connected to a top face of a free end portion of each of the blades 42*a*, and the top plate 441*a* of the blade ring 44*a* is disposed on a top face of a middle portion inside the free end portion of each of the blades 42*a*. In response to the sidewall 442*a* of the blade ring 44*a*, the top face of the free end portion of each of the blades 42*a* offsets downwardly so that a step is formed between the free end portion and the middle portion of each of the blades 42*a*. An outer periphery of the flange 443*a* is aligned with an outmost longitudinal edge 424*b* of each of the blades 42*a*. In assembly, the flange 443*a* of the blade ring 44*a* extends under and overlaps with the top cover 21 of the centrifugal fan. In this second embodiment, the middle portions of the blades 42*a* where the top plate 441*a* of the blade ring 44*a* is disposed can still have a height increase of about 1.0 mm compared with conventional centrifugal fans.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fan impeller comprising:

a hub comprising a circular top wall and a cylindrical side wall extending downwardly from a rim of the circular top wall;

a plurality of fan blades extending radially and outwardly from a periphery of the side wall of the hub; and a blade ring arranged on a top of the fan blades and comprising an annular top plate, a cylindrical sidewall extending downwardly from an outer periphery of the top plate, and a flange extending outwardly from a bottom of the cylindrical sidewall.

2. The fan impeller as claimed in claim 1, wherein the top plate covers top surfaces of the blades, and an outer periphery of the top plate is aligned with an outmost longitudinal edge of each of the fan blades.

3. The fan impeller as claimed in claim 1, wherein the top plate covers top surfaces of the fan blades, a free end portion of each of the blades offsets downwardly in response to the sidewall of the blade ring, and an outer periphery of the flange is aligned with an outmost longitudinal edge of each of the fan blades.

4. The fan impeller as claimed in claim 1, wherein each of the fan blades comprises a first portion connected with the side wall of the hub and a second portion bent slantwise and smoothly from a distal end of the first portion.

5. The fan impeller as claimed in claim 4, wherein a longitudinal height of the first portion is gradually increased as the first portion extends from the side wall of the hub towards the second portion, while a longitudinal height of the second portion is constant as the second portion extends outwardly from the first portion.

6. A centrifugal fan comprising:

a fan frame including a bottom base and an opposite top cover; and an impeller received in the fan frame, the impeller comprising a hub, a plurality of blades extending radially and outwardly from a periphery of the hub, and a blade ring comprising an annular top plate being arranged on top surfaces of the blades, a cylindrical sidewall extending downwardly from an outer periphery of the top plate, and a flange extending outwardly from a bottom of the cylindrical sidewall, the top plate of the blade ring being received in an air inlet defined in the top cover and being coplanar with the top cover.

7. The centrifugal fan as claimed in claim 6, wherein the top plate covers the top surfaces of the blades, and the flange extends into a space under the top cover of the fan frame.

8. The centrifugal fan as claimed in claim 6, wherein an outer periphery of the top plate is aligned with an outmost longitudinal edge of each of the blades.

9. The centrifugal fan as claimed in claim 6, wherein a free end portion of each of the blades offsets downwardly in response to the sidewall of the blade ring, and an outer periphery of the flange is aligned with an outmost longitudinal edge of each of the fan blades.

10. The centrifugal fan as claimed in claim 6, wherein an air inlet is defined in the bottom base, a diameter of the air inlet of the top cover is larger than that of the air inlet of the bottom base, and an inner diameter of the top plate of the blade ring is approximately the same as the diameter of the air inlet of the bottom base.

11. The centrifugal fan as claimed in claim 6, wherein each of the blades comprises a first portion connected with the hub and a second portion bent slantwise and smoothly from a distal end of the first portion, a longitudinal height of the first portion is gradually increased as the first portion extends from the hub towards the second portion, and a longitudinal height of the second portion is constant as the second portion extends outwardly from the first portion.

12. A centrifugal fan comprising:

a fan frame including a bottom base and an opposite top cover; and an impeller received in the fan frame, the impeller comprising a hub, a plurality of blades extending radially and outwardly from a periphery of the hub, and a blade ring comprising an annular top plate being arranged on top surfaces of the blades, the top plate of the blade ring being received in an air inlet defined in the top cover and being coplanar with the top cover;

wherein an air inlet is defined in the bottom base, a diameter of the air inlet of the top cover is larger than that of the air inlet of the bottom base, and an inner diameter of the top plate of the blade ring is approximately the same as the diameter of the air inlet of the bottom base.

* * * * *